US012637801B2

(12) United States Patent
Kim et al.

(10) Patent No.: US 12,637,801 B2
(45) Date of Patent: May 26, 2026

(54) DRYER AND METHOD FOR OPERATING SAME

(71) Applicant: LG ELECTRONICS INC., Seoul (KR)

(72) Inventors: Yang Gyu Kim, Seoul (KR); Chan Ho Chun, Seoul (KR); Tae Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 1007 days.

(21) Appl. No.: 17/788,829

(22) PCT Filed: Dec. 17, 2020

(86) PCT No.: PCT/KR2020/018606

§ 371 (c)(1),
(2) Date: Jun. 24, 2022

(87) PCT Pub. No.: WO2021/132990

PCT Pub. Date: Jul. 1, 2021

(65) Prior Publication Data

US 2023/0340716 A1 Oct. 26, 2023

(30) Foreign Application Priority Data

Dec. 24, 2019 (KR) ..... 10-2019-0173883

(51) Int. Cl.
*D06F 58/26* (2006.01)
*D06F 58/04* (2006.01)

(52) U.S. Cl.
CPC ..... *D06F 58/26* (2013.01); *D06F 58/04* (2013.01)

(58) Field of Classification Search
CPC ..... D06F 58/26; D06F 58/04; D06F 58/02; D06F 58/48; D06F 58/30; D06F 58/24; D06F 58/32
See application file for complete search history.

(56) References Cited

U.S. PATENT DOCUMENTS 4,122,611 A * 10/1978 Marchal ..... F26B 23/005 68/5 E
4,875,298 A * 10/1989 Wright ..... D06F 58/20 34/607

(Continued)

FOREIGN PATENT DOCUMENTS

CN 1924176 A 3/2007
CN 102869826 A 1/2013

(Continued)

OTHER PUBLICATIONS

Notice of Allowance in Korean Appln. No. 10-2019-0173883, mailed on Apr. 23, 2025, 5 pages (with English translation).

(Continued)

*Primary Examiner* — David J Laux
(74) *Attorney, Agent, or Firm* — Fish & Richardson P.C.

(57) ABSTRACT

A dryer and an operating method therefor are useful in a 5G environment provided for the Internet of Things. The dryer includes a tumbler, a fan connected to the exit of the tumbler, a heat exchanger disposed in a flow line of a working fluid connected to the exit of the fan, a compressor having an entrance connected to a flow line connected to the exit of the fan and an exit connected to the entrance of the heat exchanger, and a steam generator having an exit connected to the entrance of the compressor.

16 Claims, 6 Drawing Sheets

(56) References Cited

U.S. PATENT DOCUMENTS

| | | | | |
|---|---|---|---|---|
| 6,585,781 | B1 * | 7/2003 | Roseen | D06F 58/20 8/149.1 |
| 9,657,429 | B2 * | 5/2017 | Son | D06F 58/20 |
| 2011/0167664 | A1 * | 7/2011 | Favret | D06F 58/203 34/134 |
| 2017/0145624 | A1 * | 5/2017 | Dulberg | D06F 58/20 |
| 2020/0048823 | A1 * | 2/2020 | Spencer | D06F 73/00 |

FOREIGN PATENT DOCUMENTS

| | | | |
|---|---|---|---|
| CN | 107385827 | A | 11/2017 |
| EP | 1147252 | | 8/2004 |
| EP | 2617887 | | 7/2013 |
| JP | 2007-190249 | A | 8/2007 |
| JP | 2009505716 | | 2/2009 |
| JP | 2014023732 | | 2/2014 |
| KR | 101119120 | | 3/2012 |
| KR | 10-1237450 | B1 | 2/2013 |
| KR | 10-2017-0006555 | A | 1/2017 |
| WO | WO2008138779 | | 11/2008 |
| WO | WO2015/055982 | | 4/2015 |
| WO | 2018/054215 | A1 | 3/2018 |

OTHER PUBLICATIONS

Office Action in Chinese Appln. No. 202080089193.6, mailed on Mar. 21, 2025, 18 pages (with English translation).
Extended European Search Report in European Appln. No. 20907229.7, mailed on Dec. 6, 2023, 8 pages.
Office Action in Korean Appln. No. 10-2019-0173883, mailed on Oct. 10, 2024, 12 pages (with English translation).

* cited by examiner

DRYER AND METHOD FOR OPERATING SAME

CROSS-REFERENCE TO RELATED APPLICATIONS

This application is a National Phase Application under 35 U.S.C. § 371 of International Application No. PCT/KR2020/018606, filed on Dec. 17, 2020, which claims priority to Korean Patent Application No. 10-2019-0173883, filed Dec. 24, 2019. The disclosures of the prior applications are incorporated by reference in their entirety.

TECHNICAL FIELD

The present disclosure relates to a dryer and an operating method therefor, and more particularly to a dryer having a structure exhibiting improved heat transfer efficiency and performance and to an operating method therefor.

BACKGROUND ART

The content described in this section simply provides background information related to embodiments, and does not constitute the related art.

A dryer is used to dry an object to be dried, such as laundry. A dryer may be categorized into a gas type, an electric-heating type, and a heat-pump type depending on the method of obtaining heat for heating an object to be dried.

The gas type is a type that heats an object to be dried using heat generated by burning combustible gas. The gas-type dryer has disadvantages in that the overall size thereof is large and the structure thereof is complicated in order to receive gas supplied from outside.

The electric-heating type is a type that heats an object to be dried using heat obtained from an electric heater. The electric-heating-type dryer has advantages in that the size thereof is small and the structure thereof is simple.

However, because the electric-heating-type dryer uses electricity, which is an expensive energy source, the same is disadvantageous from the aspect of costs and energy efficiency.

The heat-pump type is a type that heats an object to be dried using heat obtained by transferring heat from a low-temperature thermal reservoir to a high-temperature thermal reservoir using a compressor.

The heat-pump-type dryer may obtain heat using a compressor, and may use electricity to operate the compressor.

However, unlike the electric-heating type, which generates heat by converting electricity into heat, the heat-pump type obtains heat by collecting heat from a low-temperature thermal reservoir and transferring the same to a high-temperature thermal reservoir, and is thus advantageous in that less power is consumed than in the case of the electric-heating type.

The demand for an electric-heating-type dryer having an advantage of low power consumption is continually increasing, and accordingly, research and development related thereto is being actively carried out.

Meanwhile, a dryer needs to perform initial heating for rapid drying. Therefore, there is a need to develop a method capable of reducing the amount of power consumed for initial heating of a dryer.

DISCLOSURE OF INVENTION

Technical Problem

An object of the present disclosure is to provide a dryer having a structure capable of reducing the amount of power consumed for initial heating and an operating method therefor.

An object of the present disclosure is to provide a dryer having a structure for performing initial heating using both a generator and a compressor in order to reduce the amount of power consumed for initial heating and an operating method therefor.

An object of the present disclosure is to provide a dryer having a structure capable of improving heat transfer efficiency using a steam trap or a preheater and an operating method therefor.

Solution to Problem

In order to accomplish the above objects, a dryer according to an embodiment of the present disclosure may include a tumbler, a fan connected to the exit of the tumbler, a heat exchanger disposed in a flow line of a working fluid connected to the exit of the fan, a compressor having an entrance connected to a flow line connected to the exit of the fan and an exit connected to the entrance of the heat exchanger, and a steam generator having an exit connected to the entrance of the compressor.

The dryer according to the embodiment of the present disclosure may further include an accommodation part configured to accommodate the heat exchanger therein.

The accommodation part may be connected to a flow line connected to the exit of the fan, a flow line connected to the entrance of the tumbler, and a flow line connected to the entrance of the compressor.

The dryer according to the embodiment of the present disclosure may further include a preheater having an entrance connected to the exit of the heat exchanger.

The preheater may be provided outside the accommodation part.

The flow line interconnecting the fan and the accommodation part may penetrate the preheater.

The dryer according to the embodiment of the present disclosure may further include a steam trap having an entrance connected to the exit of the preheater.

The dryer according to the embodiment of the present disclosure may further include a reservoir having an entrance connected to the exit of the steam trap. The reservoir may store water that has passed through the steam trap.

The dryer according to the embodiment of the present disclosure may further include a control valve mounted in a flow line interconnecting the compressor and the steam generator.

The dryer according to the embodiment of the present disclosure may further include a controller electrically connected to the fan, the compressor, the steam generator, and the control valve.

The steam generator may be connected to a water supply device, and may be provided with a heating device configured to heat water introduced from the water supply device.

The heating device may be configured as an electric heater.

A dryer according to an embodiment of the present disclosure may include a tumbler, a fan connected to the exit of the tumbler, a heat exchanger disposed in a flow line of a working fluid connected to the exit of the fan, a compressor having an entrance connected to a flow line connected to the exit of the fan and an exit connected to the entrance of the heat exchanger, a steam generator having an exit connected to the entrance of the compressor, a preheater having an entrance connected to the exit of the heat exchanger, a control valve mounted in a flow line interconnecting the compressor and the steam generator, and a controller electrically connected to the fan, the compressor, the steam generator, and the control valve.

The dryer according to the embodiment of the present disclosure may further include an accommodation part configured to accommodate the heat exchanger therein. The preheater may be provided outside the accommodation part.

The dryer according to the embodiment of the present disclosure may further include a steam trap having an entrance connected to the exit of the preheater, and a reservoir having an entrance connected to the exit of the steam trap. The reservoir may store water that has passed through the steam trap.

A dryer operating method according to an embodiment of the present disclosure may include operating the fan, operating the compressor, heating water introduced into the steam generator, opening the control valve, closing the control valve when a set time period elapses, and stopping operation of the steam generator.

The steam generator may be connected to a water supply device, and may be provided with a heating device configured to heat water introduced from the water supply device, and the heating device may be configured as an electric heater.

Advantageous Effects of Invention

According to embodiments of the present disclosure, since the steam generator and the compressor are used together for initial heating, power consumption by the dryer may be reduced compared to the case in which the electric heater is used alone for initial heating.

According to embodiments of the present disclosure, due to provision of the steam trap connected to the exit of the heat exchanger, only condensed water may be discharged from the heat exchanger, and accordingly, the efficiency of heat transfer by the heat exchanger may be improved.

According to embodiments of the present disclosure, since a portion of the heat of the working fluid discharged from the heat exchanger is collected using the preheater, the heat transfer efficiency and the coefficient of performance of the dryer may be improved.

According to embodiments of the present disclosure, due to provision of the steam trap connected to the exit of the preheater, only condensed water may be discharged to the reservoir, and accordingly, the efficiency of heat transfer by the heat exchanger and the preheater may be improved.

BRIEF DESCRIPTION OF DRAWINGS

The foregoing and other objects, features, and advantages of the invention, as well as the following detailed description of the embodiments, will be better understood when read in conjunction with the accompanying drawings. For the purpose of illustrating the invention, there is shown in the drawings an exemplary embodiment that is presently preferred, it being understood, however, that the invention is not intended to be limited to the details shown because various modifications and structural changes may be made therein without departing from the spirit of the invention and within the scope and range of equivalents of the claims. The use of the same reference numerals or symbols in different drawings indicates similar or identical items.

DESCRIPTION OF REFERENCE NUMERALS OF MAIN PARTS OF THE DRAWINGS

Figure 1:
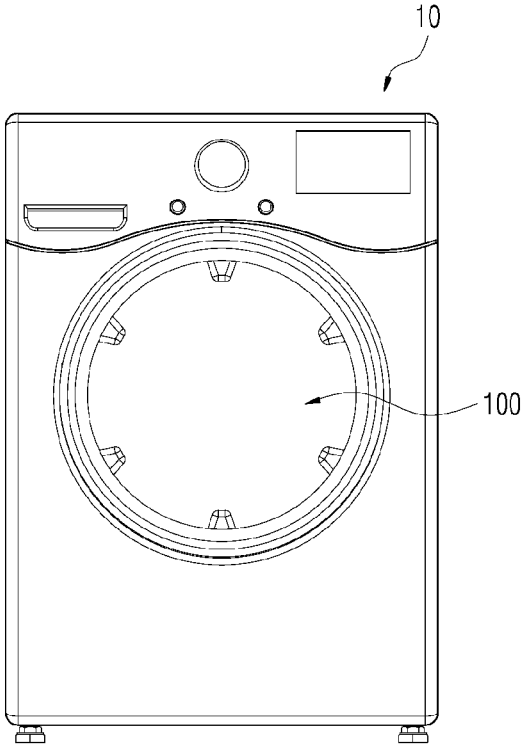
FIG. 1 is a view showing the external appearance of a dryer according to an embodiment of the present disclosure.

10: user interface
100: tumbler
200: fan
300: heat exchanger
400: compressor
500: steam generator
510: heating device
600: accommodation part
700: preheater
800: steam trap
900: reservoir
1000: control valve
1100: controller
1200: water supply device

Best Mode for Carry Out the Invention

Hereinafter, exemplary embodiments of the present disclosure will be described in detail with reference to the accompanying drawings. In the following description of the present disclosure, a detailed description of known functions and configurations incorporated herein will be omitted to make the gist of the present disclosure clear.

FIG. 1 is a view showing the external appearance of a dryer according to an embodiment. The dryer according to the embodiment may be used, for example, to dry laundry that has not been dried after completion of washing. Of course, the dryer may also be used to dry wet clothes, regardless of whether washing is performed.

An object to be dried may be received in a tumbler 100 provided in the dryer. Referring to FIG. 1, the tumbler 100 may be formed, for example, in a cylindrical shape, and may be provided so as to rotate as needed.

The dryer may be provided with a user interface 10. The user interface 10 may be electrically connected to a controller 1100 to be described later, and a user may control the operation of the dryer using the user interface 10.

For example, the user interface 10 may be provided with a display, a capacitive touch button, a physical button, a dial, a speaker through which the dryer utters a voice, a microphone through which the user inputs a voice command, and the like.

Therefore, the user may obtain information necessary for operation from the dryer in the form of text, a voice, or the like. In addition, the user may input a voice command, or may manually manipulate the button, the dial, or the like in order to operate the dryer.

The dryer may further include a transceiver, which is connected to the controller 1100, and the controller 1100 may communicate with a server, a terminal of the user, and other external devices through the transceiver.

The transceiver may include at least one of a mobile communication module or a wireless Internet module. In addition, the transceiver may further include a short-range communication module.

The mobile communication module transmits and receives wireless signals to and from at least one of a base station, an external terminal, or a server via a mobile communication network established according to technical standards or communication schemes for mobile communication (for example, global system for mobile communication (GSM), code division multi access (CDMA), code division multi access 2000 (CDMA2000), enhanced voice-data optimized or enhanced voice-data only (EV-DO), wide-band CDMA (WCDMA), high speed downlink packet access (HSDPA), high speed uplink packet access (HSUPA), long term evolution (LTE), long term evolution-advanced (LTE-A), $5^{th}$ generation (5G) mobile communication, and the like).

The wireless Internet module refers to a module for wireless Internet access. The wireless Internet module may be provided in the dryer. The wireless internet module is configured to transmit and receive wireless signals via a communication network using wireless Internet technology.

The dryer may transmit and receive data to and from a server and various terminals capable of performing communication via a 5G network. In particular, the dryer may perform data communication with the server and the terminals using at least one service among enhanced mobile broadband (eMBB), ultra-reliable and low latency communications (URLLC), and massive machine-type communications (mMTC) via a 5G network.

Enhanced mobile broadband (eMBB) is a mobile broadband service, and multimedia content, wireless data access, etc. are provided over eMBB. Further, improved mobile services, such as hotspots and broadband coverage for receiving mobile traffic, the amount of which is tremendously increasing, may be provided over eMBB. Through hotspots, high-volume traffic may be received in an area in which user mobility is low and user density is high. Through broadband coverage, a wide-range and stable wireless environment and user mobility may be ensured.

An ultra-reliable and low latency communications (URLLC) service defines much more stringent requirements than existing LTE in terms of reliability in data transmission/reception and transmission delay, and 5G services for automation of production processes at industrial sites, telemedicine, telesurgery, transportation, safety, etc. are representative examples thereof.

A massive machine-type communications (mMTC) service is a service that is not sensitive to transmission delay and is required for transmission of a relatively small amount of data. Terminals present in a much larger number than general mobile phones, such as sensors, may be connected to a wireless access network by mMTC at the same time. In this case, the communication module of the terminal needs to be inexpensive, and there is a need for improved power efficiency and power-saving technology enabling operation for years without replacement or recharging of a battery.

The dryer of the embodiment may employ a thermodynamic cycle in order to apply heat to the object to be dried received in the tumbler 100.

A working fluid used to implement the thermodynamic cycle of the dryer may be a mixture of air and gaseous water, i.e. steam. In this case, the ratio of air to steam in the working fluid may change while the working fluid circulates through the respective components of the dryer.

Figure 2:
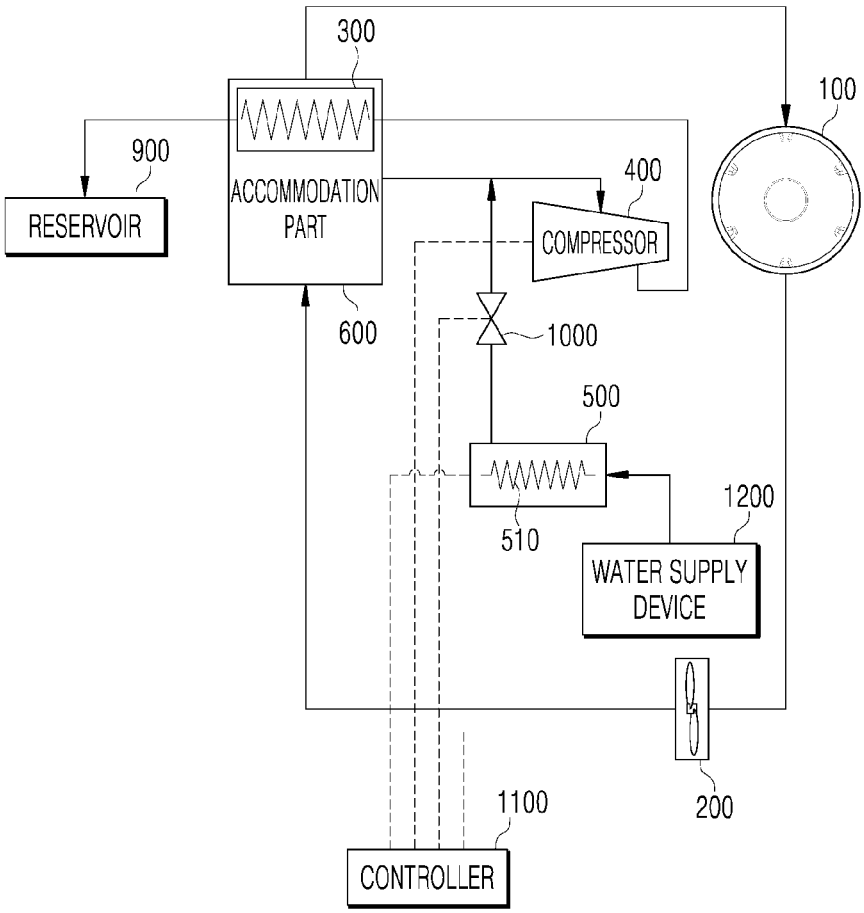
FIG. 2 is a diagram showing the structure of a dryer according to an embodiment of the present disclosure.

FIG. 2 is a diagram showing the structure of a dryer according to an embodiment.

The dryer may be provided with a flow line through which the working fluid flows. The flow line may interconnect respective components of the dryer, which will be described below. The flow line may be configured as, for example, a pipe, a hose, a duct, or a combination thereof.

The flow line of the working fluid in the dryer may include a circulation line and a non-circulation line.

The circulation line is a line interconnecting a tumbler 100, a fan 200, and a heat exchanger 300, and the working fluid may circulate along the circulation line. The fan 200 may blow the working fluid so that the working fluid flows along the circulation line.

The non-circulation line may branch from the circulation line upstream of the heat exchanger 300 so as to be connected to a compressor 400, and may be connected to the compressor 400 and the heat exchanger 300. The working fluid flowing through the non-circulation line may be introduced into and compressed by the compressor 400, may pass through the heat exchanger 300, and may then be discharged outside.

A portion of the working fluid in the circulation line may be introduced into the non-circulation line, which branches from the circulation line. The working fluid introduced into the non-circulation line may be compressed by the compressor 400, and thus may be heated to a high temperature.

The heated working fluid discharged from the compressor 400 in the non-circulation line may be introduced into the heat exchanger 300, may exchange heat with the working fluid in the circulation line, which has a relatively low temperature, and may then be introduced into a reservoir 900 from the heat exchanger 300.

As described above, the working fluid in the circulation line is heated by the heat exchanger 300, and is introduced into the tumbler 100 to heat the object to be dried accommodated in the tumbler 100, thereby drying the object to be dried.

After operation of the dryer commences, it is necessary to quickly heat the object to be dried in the initial stage of a drying operation in order to quickly and efficiently perform the drying operation.

This initial heating serves to heat the working fluid in the circulation line. Generally, in order to implement initial heating, an electric heater may be provided in the circulation line connected to the entrance of the tumbler 100.

The electric heater may heat the working fluid flowing through the circulation line. The heated working fluid may flow into the tumbler 100, and the object to be dried in the tumbler 100 may be heated by the working fluid. Accordingly, the water contained in the object to be dried may be evaporated and vaporized.

The electric-heater type, which heats the working fluid using electricity, may be disadvantageous from the aspect of a coefficient of performance (COP) compared to a heat-pump type, which heats the working fluid using the compressor 400.

That is, the electric-heater type has a lower COP than the heat-pump type. The COP is defined as follows.

$$COP = \text{Generated Heat}/\text{Input Work}$$

Here, input work includes electrical work, work by the compressor 400, and the like.

The electric heater has a COP close to 1. An ideal electric heater completely converts input work, i.e. electrical work, into heat. That is, an ideal electric heater has a COP of 1. However, an actual electric heater may have a COP less than 1.

Meanwhile, the compressor 400 has a COP greater than 1. The reason for this is that the heat-pump type using the compressor 400 generates heat in the manner of transferring heat from a low-temperature thermal reservoir to a high-temperature thermal reservoir, unlike the electric-heater type, which converts electricity into heat.

Therefore, in order to generate a given amount of heat, the compressor 400 may use a smaller amount of power than the electric heater. That is, the amount of power consumed for initial heating may be reduced when the compressor 400 is used alone or when the compressor 400 and the electric heater are used together compared to when the electric heater is used alone.

Hereinafter, the structure of the dryer according to the embodiment capable of reducing power consumption will be described in detail with reference to FIG. 2 and the drawings below.

Referring to FIG. 2, the dryer according to the embodiment may include a tumbler 100, a fan 200, a heat exchanger 300, a compressor 400, and a steam generator 500. The structure and function of the tumbler 100 are as described above.

The fan 200 may be disposed so as to be connected to the exit of the tumbler 100. The fan 200 and the tumbler 100 may be connected to each other via the circulation line of the working fluid. The fan 200 may blow the working fluid introduced from the tumbler 100 so that the working fluid circulates through the circulation line.

The heat exchanger 300 may be disposed in the flow line of the working fluid that is connected to the exit of the fan 200. That is, the heat exchanger 300 may be disposed in the circulation line of the working fluid that interconnects the fan 200 and the tumbler 100.

In addition, the heat exchanger 300 may be configured such that the non-circulation line of the working fluid, which is connected to the exit of the compressor 400, passes therethrough.

Due to this structure, the working fluid in the circulation line, which has a relatively low temperature, and the working fluid in the non-circulation line, which is compressed by the compressor 400 and thus has a relatively high temperature, may exchange heat therebetween in the heat exchanger 300.

Meanwhile, during initial heating, the working fluid in the non-circulation line is further heated by the steam generator 500 to be described later, whereby heat exchange may occur more actively in the heat exchanger 300.

The working fluid in the circulation line, which is heated through the heat exchanger 300, may flow back into the tumbler 100, and may heat and dry the object to be dried in the tumbler 100.

The dryer according to the embodiment may further include an accommodation part 600, in which the heat exchanger 300 is accommodated. For example, the accommodation part 600 may be configured as a duct, and may constitute part of the circulation line.

The accommodation part 600 may be designed to have a large cross-sectional area in order to increase the contact area between the working fluid in the circulation line and the surface of the heat exchanger 300, thereby increasing the efficiency of heat transfer between the working fluid in the circulation line and the working fluid in the non-circulation line.

However, it is appropriate to set the cross-sectional area of the accommodation part 600 in consideration of the overall size of the dryer, the size of the space occupied by the accommodation part 600, and the size of the heat exchanger 300.

As shown in FIG. 2, the accommodation part 600 may be connected to the flow line connected to the exit of the fan 200, to the flow line connected to the entrance of the tumbler 100, to the flow line connected to the entrance of the compressor 400, and to the flow line connected to the entrance of the reservoir 900.

That is, the accommodation part 600 may be connected both to the circulation line and to the non-circulation line of the working fluid. The heat exchanger 300 may be configured as, for example, an open type, in which the working fluid in the circulation line and the working fluid in the non-circulation line mix with each other, or a closed type, in which the two working fluids flow separately from each other. The heat exchanger 300 according to the embodiment may be configured as, for example, a closed type.

When the closed-type heat exchanger 300 is used, the non-circulation line of the working fluid may be directly connected to the heat exchanger 300 disposed in the accommodation part 600, and the working fluid in the non-circulation line may be separated from the working fluid in the circulation line inside the accommodation part 600, rather than being mixed therewith.

The compressor 400 may be connected at the entrance thereof to the flow line connected to the exit of the fan 200, and may be connected at the exit thereof to the entrance of the heat exchanger 300.

The compressor 400 may be connected to the non-circulation line of the working fluid, and a portion of the working fluid flowing through the circulation line may be introduced into the compressor 400. The working fluid introduced into the non-circulation line may be compressed by the compressor 400 to a high temperature, and may then be introduced into the heat exchanger 300.

The compressor 400 may be configured as any of various types, such as, for example, a reciprocating type, a rotary type, a screw type, a scroll type, a centrifugal type, and an axial type. It is appropriate to select the type of compressor 400 in consideration of the size and the specific characteristics thereof.

The steam generator 500 may be connected at the exit thereof to the entrance of the compressor 400. The steam generator 500 may generate steam, and the steam discharged from the steam generator 500 may be introduced into the non-circulation line connected to the entrance of the compressor 400.

Due to provision of the steam generator 500, the working fluid introduced into the compressor 400 may contain high-temperature steam discharged from the steam generator 500. Accordingly, the working fluid introduced into the compressor 400 may be heated more than in the case in which the steam generator 500 is omitted.

In addition, the working fluid, which contains the steam discharged from the steam generator 500, may be introduced into the compressor 400, and the temperature of the working fluid may be further increased by the compressor 400. The working fluid discharged from the compressor 400 may be introduced into the heat exchanger 300, and may heat the working fluid in the circulation line.

Therefore, the dryer according to the embodiment may perform initial heating using the steam generator 500 and the compressor 400.

The steam generator 500 may generate steam using, for example, an electric heater. Therefore, the dryer according to the embodiment may perform initial heating using the electric heater and the compressor 400.

The work by the compressor 400 has a higher COP than electrical work. This will be apparent to those of ordinary skill in the art to which the present disclosure pertains. That is, in order to generate a given amount of heat, the compressor 400 performs less work than the electric heater.

Accordingly, during initial heating, when the steam generator 500 and the compressor 400 are used together, a smaller amount of power is consumed to obtain a desired amount of heat than when the electric heater is used alone.

According to the embodiment, since the steam generator 500 and the compressor 400 are used together for initial heating, power consumption by the dryer may be reduced compared to the case in which the electric heater is used alone for initial heating.

The steam generator 500 may be connected to a water supply device 1200. The water supply device 1200 may supply condensed water, i.e. liquid water, to the steam generator 500.

The steam generator 500 may be provided with a heating device 510 for heating water introduced from the water supply device 1200. The heating device 510 may be configured as, for example, an electric heater.

The condensed water introduced into the steam generator 500 may be heated and evaporated to steam by the heating device 510, and the steam may be introduced into the compressor 400 through the non-circulation line connected to the compressor 400.

The dryer according to the embodiment may further include a control valve 1000. The control valve 1000 may be mounted in the flow line interconnecting the compressor 400 and the steam generator 500. The control valve 1000 may control introduction of the steam generated in the steam generator 500 into the non-circulation line.

The steam generator 500 may be used for initial heating, and operation thereof may be stopped when initial heating is completed. Therefore, during initial heating, the control valve 1000 may be opened so that steam is introduced into the non-circulation line from the steam generator 500.

When initial heating is sufficiently performed, the control valve 1000 may be closed in order to interrupt the introduction of steam from the steam generator 500 into the non-circulation line, and operation of the steam generator 500 may be stopped. Thereby, initial heating may be terminated.

During initial heating, the object to be dried in the tumbler 100 is continuously heated, and accordingly, the water contained in the object to be dried continues to evaporate, so the working fluid in the circulation line and the working fluid in the non-circulation line contain a sufficient amount of steam. Thereby, heat exchange may be smoothly performed in the heat exchanger 300, and at this time initial heating may be terminated.

In one embodiment, the time period required for initial heating may be set in consideration of the specifications of the dryer, and initial heating may be terminated when the set time period elapses.

In another embodiment, the humidity of the working fluid may be measured using a humidity sensor, which is disposed at an appropriate position among the circulation line of the working fluid, the non-circulation line of the working fluid, and the respective components, and initial heating may be terminated when the humidity reaches a predetermined range.

The dryer according to the embodiment may further include a reservoir 900 and a controller 1100.

The reservoir 900 may be connected to the exit of the heat exchanger 300, and may store water that has passed through the heat exchanger 300. While the working fluid passes through the heat exchanger 300 before entering the reservoir 900, at least a portion of the steam contained in the working fluid may be condensed by heat exchange in the heat exchanger 300, so liquid water, i.e. condensed water, may be generated. Thus, the reservoir 900 may store the condensed water introduced from the heat exchanger 300.

The controller 1100 may be electrically connected to the fan 200, the compressor 400, the steam generator 500, and the control valve 1000. In addition, the controller 1100 may be electrically connected to other components of the dryer that need to be electrically controlled.

The controller 1100 may control the respective components of the dryer, and thus may control the overall operation of the dryer according to the embodiment. For example, the controller 1100 may control the operation of the fan 200, may control the operation of the compressor 400, may control the operation of the heating device 510 of the steam generator 500, or may control opening and closing of the control valve 1000.

As described above, the controller 1100 may be connected to the user interface and the transceiver to receive a user's command, to transmit a necessary notification to the user, or to communicate with an external device such as a server.

Figure 3:
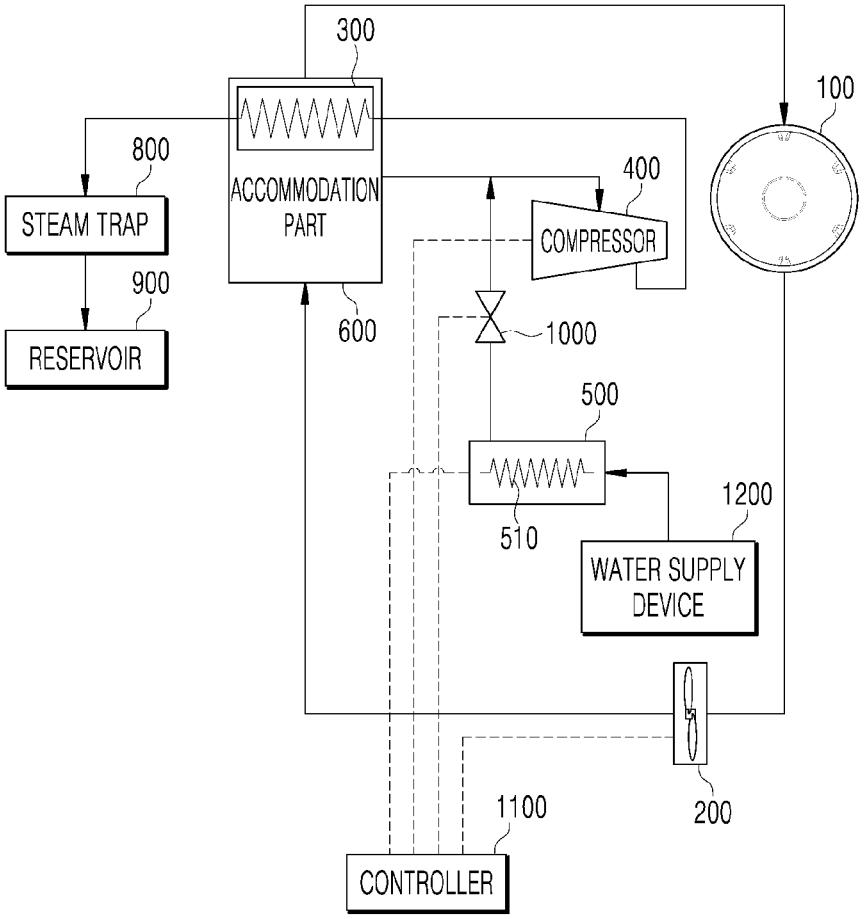
FIG. 3 is a diagram showing the structure of a dryer according to another embodiment of the present disclosure.

FIG. 3 is a diagram showing the structure of a dryer according to another embodiment. As shown in FIG. 3, the dryer may include a steam trap 800.

The steam trap 800 may be disposed in the non-circulation line, and may be connected at the entrance thereof to the exit of the heat exchanger 300. The working fluid introduced into the steam trap 800 may contain condensed water and steam. The reason for this is that at least a portion of the steam contained in the working fluid is condensed while the working fluid passes through the heat exchanger 300.

The condensed water contained in the working fluid introduced into the steam trap 800 passes through the steam trap 800 and is introduced into the reservoir 900, and the steam contained therein does not pass through the steam trap 800. The steam that does not pass through the steam trap 800 may remain in the heat exchanger 300, and may be used to heat the working fluid in the circulation line.

According to the embodiment, due to provision of the steam trap 800 connected to the exit of the heat exchanger 300, only condensed water may be discharged from the heat exchanger 300, and accordingly, the efficiency of heat transfer by the heat exchanger 300 may be improved.

Figure 4:
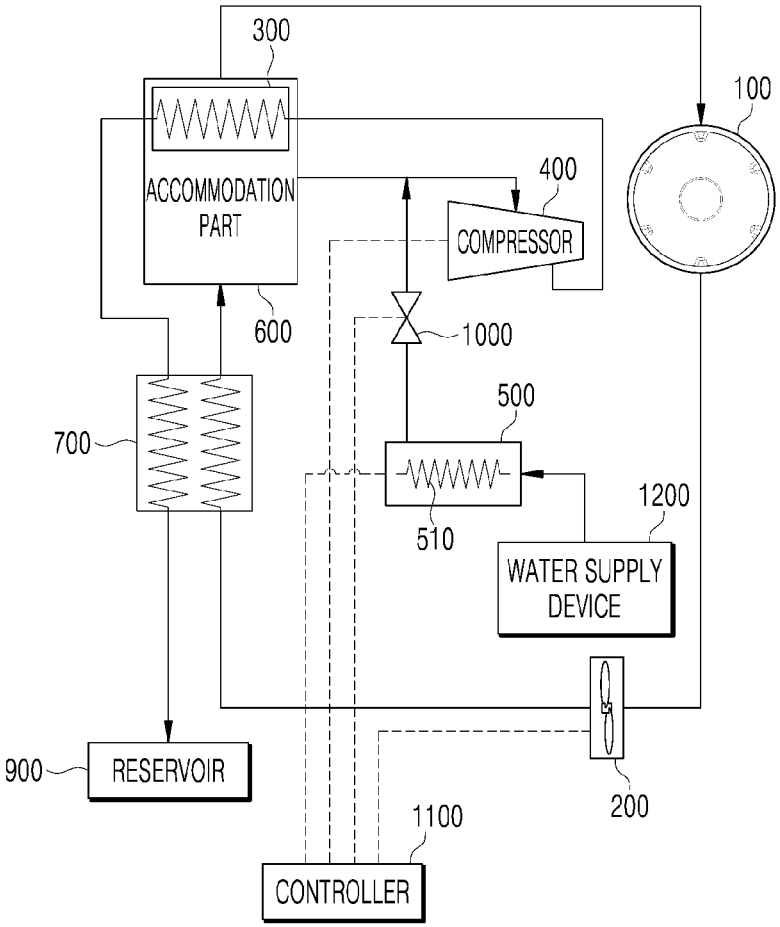
FIG. 4 is a diagram showing the structure of a dryer according to still another embodiment of the present disclosure.

FIG. 4 is a diagram showing the structure of a dryer according to still another embodiment. As shown in FIG. 4, the dryer may further include a preheater 700, which is connected at the entrance thereof to the exit of the heat exchanger 300.

The preheater 700 may be disposed in the non-circulation line interconnecting the heat exchanger 300 and the reservoir 900. In addition, the flow line interconnecting the fan 200 and the accommodation part 600, i.e. the circulation line, may be provided so as to penetrate the preheater 700.

The high-temperature working fluid discharged from the heat exchanger 300 and the low-temperature working fluid that has passed through the fan 200 may exchange heat with each other in the preheater 700. Accordingly, the working fluid that has passed through the fan 200 may be heated in the preheater 700, may be introduced into the accommodation part 600, and may be further heated by the heat exchanger 300 in the accommodation part 600.

Due to provision of the preheater 700, a portion of the heat of the working fluid discharged from the heat exchanger 300 may be used to heat the working fluid flowing through the preheater 700 in the circulation line. Accordingly, the heat transfer efficiency and the COP of the dryer may be improved.

In this case, the preheater 700 may be formed in a closed type so that the working fluid flowing through the non-circulation line and the working fluid flowing through the circulation line do not mix with each other.

The preheater 700 may be provided outside the accommodation part 600. Due to this structure, the heat exchanger 300 and the preheater 700 may be provided so as to be separated from each other by the accommodation part 600.

Accordingly, the preheater 700 may heat the working fluid in the circulation line, which has a relatively low temperature, and the heat exchanger 300 may heat the working fluid in the circulation line that has passed through the preheater 700 and thus has a relatively high temperature.

Since the working fluid in the circulation line that has a relatively low temperature is first heated by the preheater 700 and subsequently the working fluid in the circulation line that has a relatively high temperature is heated by the heat exchanger 300, the heat transfer efficiency and the COP of the dryer may be increased.

Since the working fluid in the non-circulation line that passes through the preheater 700 exchanges heat with the working fluid in the circulation line in the preheater 700, the quality of the water contained in the working fluid discharged from the preheater 700 in the non-circulation line may be lower than that in the working fluid discharged from the heat exchanger 300.

Accordingly, in the case in which the preheater 700 is provided, the proportion of condensed water in the working fluid flowing into the reservoir 900 may increase compared to the case in which the preheater 700 is omitted.

The increase in the proportion of condensed water in the working fluid flowing into the reservoir 900 means that transfer of heat from the working fluid in the non-circulation line to the working fluid in the circulation line increases, resulting in improvement of the heat transfer efficiency and the COP of the dryer.

In addition, according to the embodiment, since a portion of the heat of the working fluid discharged from the heat exchanger 300 is collected using the preheater 700, the heat transfer efficiency and the COP of the dryer may be improved.

Figure 5:
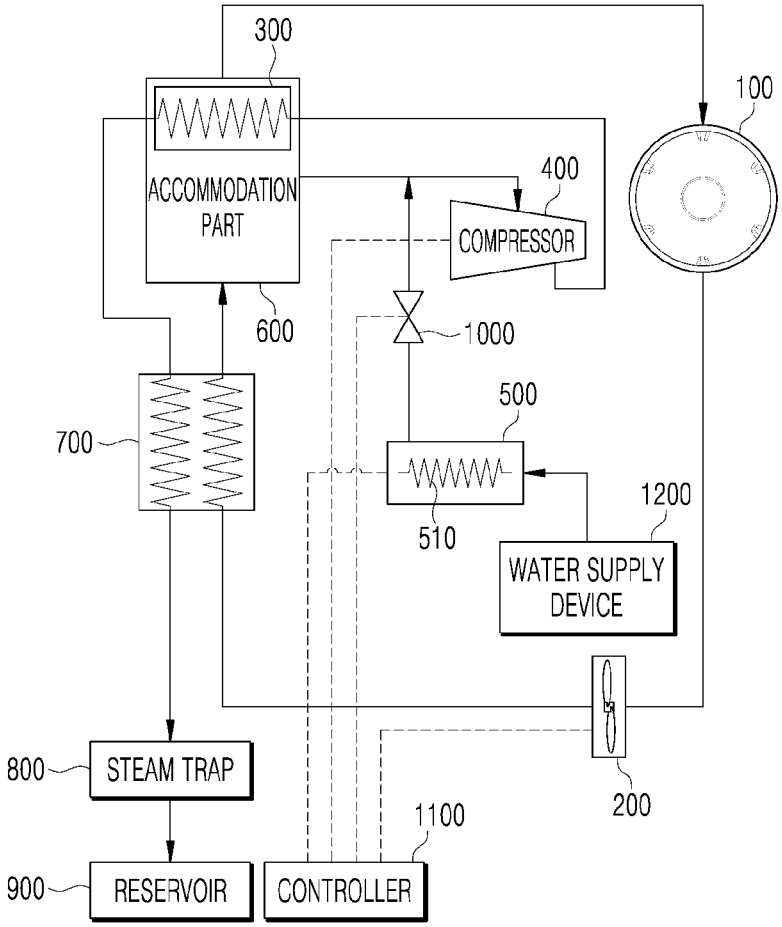
FIG. 5 is a diagram showing the structure of a dryer according to still another embodiment of the present disclosure.

FIG. 5 is a diagram showing the structure of a dryer according to still another embodiment. As shown in FIG. 5, the dryer may further include a steam trap 800, which is connected at the entrance thereof to the exit of the preheater 700.

In this case, the reservoir 900 may be disposed such that the entrance thereof is connected to the exit of the steam trap 800, and may store water that has passed through the steam trap 800.

The steam trap 800 may be disposed in the non-circulation line interconnecting the preheater 700 and the reservoir 900. The working fluid introduced into the steam trap 800 may contain condensed water and steam. The reason for this is that at least a portion of the steam contained in the working fluid is condensed while the working fluid passes through the heat exchanger 300 and the preheater 700.

The condensed water contained in the working fluid introduced into the steam trap 800 passes through the steam trap 800 and is introduced into the reservoir 900, and the steam contained therein does not pass through the steam trap 800. The steam that does not pass through the steam trap 800 may remain in the heat exchanger 300 and the preheater 700, and may be used to heat the working fluid in the circulation line.

According to the embodiment, due to provision of the steam trap 800 connected to the exit of the preheater 700, only condensed water may be discharged to the reservoir 900, and accordingly, the efficiency of heat transfer by the heat exchanger 300 and the preheater 700 may be improved.

Figure 6:
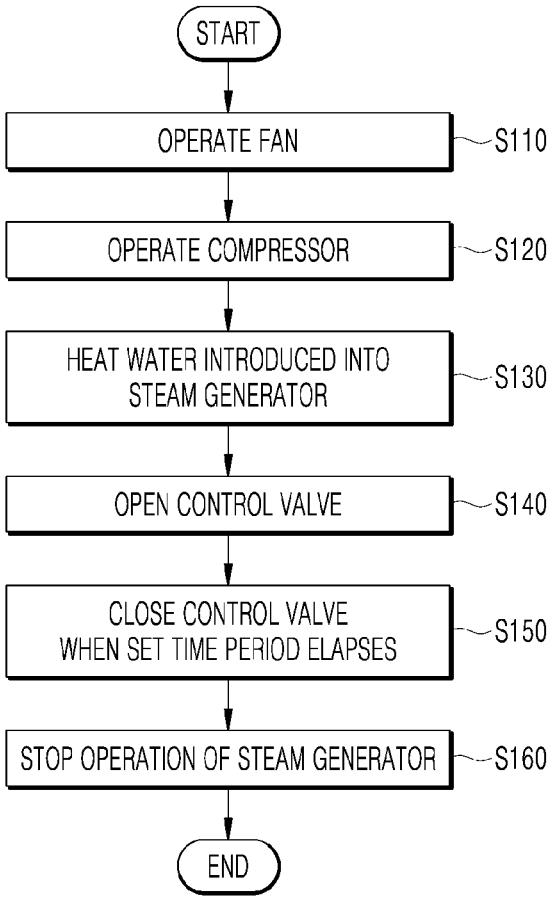
FIG. 6 is a flowchart showing a dryer operating method according to an embodiment of the present disclosure.

FIG. 6 is a flowchart showing a dryer operating method according to an embodiment. The dryer operating method of the embodiment may be used for the dryer described above. The operation of the dryer may be performed, for example, by the above-described controller 1100.

The dryer operating method of the embodiment may relate to initial heating of the dryer. Hereinafter, commencement and completion of initial heating of the dryer will be described in detail.

When an object to be dried is received in the tumbler 100, the controller 1100 may operate the fan 200 (S110).

As the fan 200 operates, the working fluid may flow through the circulation line of the dryer. In step S110, the working fluid in the circulation line is in a non-heated state.

The controller 1100 may operate the compressor 400 (S120). As the compressor 400 operates, the working fluid may be introduced into the compressor 400 through the non-circulation line branching from the circulation line, and may be compressed.

For example, the non-circulation line may branch from the flow line, and a portion of the working fluid in the flow line may be introduced into the compressor 400. The working fluid in the non-circulation line may be compressed to a high temperature by the compressor 400, and may be introduced into the heat exchanger 300.

It is necessary to quickly heat the object to be dried at the initial stage of a drying operation in order to quickly and efficiently perform the drying operation. When the compressor 400 operates, the working fluid in the non-circulation line may be heated, and the working fluid in the circulation line may be heated through heat exchange in the heat exchanger 300.

According to the embodiment, the working fluid in the non-circulation line may be further heated using the steam generator 500 in order to more rapidly heat the object to be dried to thus more quickly evaporate the water contained in the object to be dried.

The controller 1100 may heat the water introduced into the steam generator 500 (S130). For example, the controller 1100 may apply power to the heating device 510, which is provided in the steam generator 500 and is configured as an electric heater, in order to heat the water in the steam generator 500.

The water in the steam generator 500 may be heated, and thus at least a portion thereof may be evaporated to steam. The steam generated in the steam generator 500 may be introduced into the non-circulation line.

The controller 1100 may open the control valve 1000 (S140). When the control valve 1000 is opened, the steam in the steam generator 500 may be introduced into the non-circulation line upstream of the compressor 400 through the flow line in which the control valve 1000 is disposed.

The working fluid introduced from the circulation line and the steam introduced from the steam generator 500 may mix with each other in the non-circulation line, and accordingly, the rate of flow of the working fluid may increase, and the working fluid may be heated.

The working fluid may be introduced into the compressor 400, and may be compressed to a high temperature. The working fluid discharged from the compressor 400 in the non-circulation line may exchange heat with the working fluid in the circulation line in the heat exchanger 300 and the preheater 700, thereby heating the working fluid in the circulation line.

The heated working fluid in the circulation line may be introduced into the tumbler 100, and may heat the object to be dried received in the tumbler 100, thereby evaporating the water contained in the object to be dried.

When a set time period elapses, the controller 1100 may close the control valve 1000 (S150). When the control valve 1000 is closed, initial heating of the working fluid in the circulation line by the steam generator 500 may be terminated.

As described above, during initial heating, the object to be dried in the tumbler 100 is continuously heated, and accordingly, the water contained in the object to be dried continues to evaporate, so the working fluid in the circulation line and the working fluid in the non-circulation line contain a sufficient amount of steam. Thereby, heat exchange may be smoothly performed in the heat exchanger 300, and at this time initial heating may be terminated.

In one embodiment, the time period required for initial heating may be set in consideration of the specifications of the dryer, and initial heating may be terminated when the set time period elapses.

In another embodiment, the humidity of the working fluid may be measured using a humidity sensor, which is disposed at an appropriate position among the circulation line of the working fluid, the non-circulation line of the working fluid, and the respective components, and initial heating may be terminated when the humidity reaches a predetermined range.

The controller 1100 may stop the operation of the steam generator 500 (S160). When the control valve 1000 is closed and thus the initial heating process of the dryer is terminated, the controller 1100 may interrupt the supply of power to the heating device 510 provided in the steam generator 500, thereby stopping the operation of the steam generator 500.

The present disclosure described as above is not limited by the aspects described herein and accompanying drawings. It should be apparent to those skilled in the art that various substitutions, changes, and modifications that are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

Mode(s) for Carrying Out the Invention

Many modifications to the above embodiments may be made without altering the nature of the invention. The dimensions and shapes of the components and the construction materials may be modified for particular circumstances. While various embodiments have been described above, it should be understood that they have been presented by way of example only, and not as limitations.

INDUSTRIAL APPLICABILITY

According to the dryer and the operating method therefor according to the present disclosure, since the steam generator and the compressor are used together for initial heating, power consumption by the dryer may be reduced compared to the case in which the electric heater is used alone for initial heating. As such, since the present disclosure overcomes the limits of existing technology, the present disclosure is not only useful in the field discussed herein, but also increases the marketability and business potential of apparatuses to which the present disclosure is applicable, and can be practically and explicitly implemented. Accordingly, the present disclosure has industrial applicability.

The invention claimed is:

1. A dryer comprising:

a tumbler configured to receive one or more objects to be dried;

a fan connected to an exit of the tumbler;

a heat exchanger connected to an exit of the fan through a first flow line, the first flow line connecting the tumbler, the fan, and the heat exchanger and being configured to carry a working fluid;

a compressor having (i) an entrance connected to the first flow line and (ii) an exit connected to an entrance of the heat exchanger;

a steam generator having an exit connected to the entrance of the compressor, wherein the compressor is disposed between the steam generator and the heat exchanger;

a control valve disposed at a flow line that connects the exit of the steam generator to the entrance of the compressor; and a water supply device connected to the steam generator and configured to supply water to the steam generator, the steam generator comprising an electric heater configured to heat the water supplied from the water supply device, wherein the control valve is configured to (i) open during an initial heating of the first flow line in which the steam generator and the compressor are driven, and (ii) close to terminate the initial heating of the first flow line.

2. The dryer according to claim 1, further comprising:

an accommodation duct that accommodates the heat exchanger therein, the accommodation duct being connected to (i) the first flow line, (ii) a second flow line connected to an entrance of the tumbler, and (iii) a third flow line connected to the entrance of the compressor.

3. The dryer according to claim 2, further comprising:

a preheater having an entrance connected to an exit of the heat exchanger, wherein the preheater accommodates (i) a portion of the first flow line that connects an outlet of the fan to an entrance of the accommodation duct and (ii) a flow line connected to the exit of the heat exchanger, the preheater being configured to exchange heat between the portion of the first flow line and the flow line connected to the exit of the heat exchanger to thereby provide preheat to the working fluid in the portion of the first flow line before entering the accommodation duct.

4. The dryer according to claim 3, wherein the preheater is disposed outside the accommodation duct.

5. The dryer according to claim 4, wherein the first flow line passes through the preheater.

6. The dryer according to claim 3, further comprising:

a steam trap having an entrance connected to an exit of the preheater.

7. The dryer according to claim 6, further comprising:

a reservoir connected to an exit of the steam trap and configured to store water having passed through the steam trap.

8. The dryer according to claim 1, further comprising:

a controller that is electrically connected to each of the fan, the compressor, the steam generator, and the control valve and configured to control each of the fan, the compressor, the steam generator, and the control valve.

9. The dryer according to claim 1, wherein the working fluid comprises steam generated by the steam generator.

10. A dryer comprising:

a tumbler configured to receive one or more objects to be dried;

a fan connected to an exit of the tumbler;

a heat exchanger connected to an exit of the fan through a first flow line, the first flow line connecting the tumbler, the fan, and the heat exchanger and being configured to carry a working fluid;

a compressor having (i) an entrance connected to the first flow line and (ii) an exit connected to an entrance of the heat exchanger;

a steam generator having an exit connected to the entrance of the compressor, wherein the compressor is disposed between the steam generator and the heat exchanger;

a preheater having an entrance connected to an exit of the heat exchanger, the preheater being configured to provide preheat to a portion of the first flow line carrying the working fluid from the fan;

a control valve disposed at a second flow line that connects the steam generator to the compressor;

a controller that is electrically connected to each of the fan, the compressor, the steam generator, and the control valve and configured to control each of the fan, the compressor, the steam generator, and the control valve; and a water supply device connected to the steam generator and configured to supply water to the steam generator, the steam generator comprising an electric heater configured to heat the water supplied from the water supply device, wherein the control valve is configured to (i) open during an initial heating of the first flow line in which the steam generator and the compressor are driven, and (ii) close to terminate the initial heating of the first flow line.

11. The dryer according to claim 10, further comprising:

an accommodation duct that accommodates the heat exchanger therein, wherein the preheater is disposed outside the accommodation duct.

12. The dryer according to claim 11, further comprising:

a steam trap connected to an exit of the preheater; and a reservoir connected to an exit of the steam trap and configured to store water having passed through the steam trap.

13. The dryer according to claim 12, wherein the preheater accommodates portions of (i) the first flow line connected to an entrance of the accommodation duct and (ii) a third flow line connected to the exit of the heat exchanger, the preheater being configured to exchange heat between the first flow line and the third flow line.

14. The dryer according to claim 10, wherein the working fluid comprises steam generated by the steam generator.

15. A method for operating the dryer of claim 10, the method comprising:

operating the fan;

operating the compressor;

heating water introduced into the steam generator;

opening the control valve;

closing the control valve based on an elapse of a set time period after opening the control valve; and stopping operation of the steam generator, wherein heating the water comprises operating the electric heater to thereby heat the water introduced from the water supply device into the steam generator.

16. The method according to claim 15, further comprising:

based on operating the compressor, supplying a portion of the working fluid in the first flow line to the compressor;

supplying steam generated by the steam generator to the compressor based on opening the control valve while supplying the portion of the working fluid in the first flow line to the compressor; and supplying the working fluid compressed by the compressor to the heat exchanger.

* * * * *